United States Patent [19]

Dounchis

[11] 4,169,800

[45] Oct. 2, 1979

[54] TURBINE LUBRICANT

[75] Inventor: Harry Dounchis, Gladwyne, Pa.

[73] Assignee: FMC Corporation, Philadelphia, Pa.

[21] Appl. No.: 856,867

[22] Filed: Dec. 2, 1977

[51] Int. Cl.[2] ..... C10M 1/46; C10M 3/40; C10M 7/44; C10M 5/24

[52] U.S. Cl. ..... 252/49.9; 252/50; 252/78.5

[58] Field of Search ..... 252/49.9, 50, 78.5

[56] References Cited

U.S. PATENT DOCUMENTS

| | | | |
|---|---|---|---|
| 2,413,852 | 1/1947 | Turner | 252/49.9 |
| 2,605,226 | 7/1952 | Vaughn | 252/49.9 |
| 2,730,499 | 1/1956 | Pokorny | 252/49.8 |
| 2,779,739 | 1/1957 | Spivack | 252/49.8 |
| 2,842,497 | 7/1958 | Watson | 252/49.9 |
| 2,934,500 | 4/1960 | Cantrell et al. | 252/49.9 |
| 3,414,618 | 12/1968 | Randell | 260/576 |
| 3,553,131 | 1/1971 | Hepplewhite et al. | 252/46.7 |
| 3,790,478 | 2/1974 | Rudston et al. | 252/34 |
| 3,926,823 | 12/1975 | Durr et al. | 252/49.9 |
| 3,931,022 | 1/1976 | Chesluk et al. | 252/49.9 |
| 3,931,023 | 1/1976 | Dounchis | 252/49.8 |
| 3,992,309 | 11/1976 | Dounchis | 252/50 |

FOREIGN PATENT DOCUMENTS

| | | |
|---|---|---|
| 978932 | 12/1975 | Canada . |
| 2152892 | 4/1973 | France . |
| 1370728 | 10/1974 | United Kingdom . |

*Primary Examiner*—Delbert E. Gantz
*Assistant Examiner*—Irving Vaughn
*Attorney, Agent, or Firm*—Robert W. Kell; Frank Ianno

[57] ABSTRACT

A turbine lubricant having outstanding oxidation stability, corrosion resistance and good viscosity stability is based on a liquid mixed isopropylphenyl/phenyl phosphate ester and contains small amounts of an amine selected from the group consisting of phenyl-$\alpha$-napthylamine, phenyl-$\beta$-naphthylamine, and diphenylamine; benzotriazole, and a corrosion inhibitor selected from the group consisting of oleylsarcosine, epoxidized soybean oil, and a mixed mono- and dialkyl phosphate of the formula $RH_2PO_4$ and $R_2HPO_4$, wherein R is an alkyl group of 8–12 carbon atoms.

21 Claims, No Drawings

TURBINE LUBRICANT

This invention relates to lubricants especially adapted to the lubrication of gas turbines and, in particular, steam turbines employed in naval and other marine use where severe conditions conducive to corrosion are encountered. Though especially designed for use in gas turbines, the lubricants of the invention, because of their excellent stability at high temperatures, are particularly suitable for use in all applications wherein high use temperatures are routinely encountered and where rusting conditions are present.

The use of triaryl phosphate esters as lubricants is known and is described in French Patent No. 2,152,892 and U.S. Pat. No. 3,931,023. These patents also describe certain additives, which improve the oxidation and corrosion characteristics of phosphate ester lubricants, when present in small amounts.

The use of small quantities of phenyl-$\alpha$- or -$\beta$-naphthylamines to improve the oxidation characteristic of lubricants is taught in U.S. Pat. Nos. 2,730,499, 3,553,131, 2,413,852, 3,414,618, 2,779,739 and 2,842,497.

Other additives sometimes present in lubricating oils are the known corrosion inhibitors sometimes referred to as copper pacifiers. The use of benzotriazole as a lubricant additive is taught in U.S. Pat. Nos. 3,790,478, 3,931,022, 3,707,500 and 3,926,823 and French Patent No. 2,152,892.

The use of phosphate esters derived from $C_8$–$C_{12}$ alcohols (ORTHOLEUM 162) as a lubricant additive is described in U.S. Pat. Nos. 2,605,226, 2,779,739, 3,931,023 and French Pat. No. 2,152,842.

No single additive package, however, has been entirely satisfactory in the lubrication of modern gas turbines, because the lubricant comes in contact with condensed steam and, at times, even with sea water due to leaks in the condensing and cooling systems. The lubricant must separate successfully from the water without the formation of troublesome emulsions and must be stable to protect the metal surfaces of the turbines from corrosion, even under these severe conditions. Corrosion protection is needed by those parts that are wetted by the oil. The lubricant must not foam to any substantial extent. Also, for commercial reasons, the lubricant should be entirely homogeneous and free from suspended matter and compatible with other additives such as those additives which improve the load-carrying ability of the lubricant.

The problem of thermal stability in turbine lubricants may be handled by the use of specific alkylphenyl/phenyl phosphate base stocks, which generally also have low temperature properties, being fluid at temperatures of −40° C. or below. A more difficult problem, however, is that of oxidation stability and resistance to corrosion which arises owing to the fact that the lubricants have to operate at high oil temperatures (about 200° C.) in contact with air. These conditions have the effect of greatly accelerating the oxidative deterioration of the lubricant, which generally results in an increase in its viscosity and acidity, and corrosion of or formation of deposits on metal surfaces. Excessive increases in viscosity may result in restricted flow of lubricant to the engine bearings, resulting in less than adequate lubrication on starting. A decrease in lubricant viscosity, on the other hand, leads to a different problem, which arises because a lubricant of low viscosity is very thin and lacks "body" under the high temperature operating conditions.

Alkyl substituted triarylphosphates in which the alkyl group contains a 3° benzylic hydrogen, as typified by the isopropylphenyl moiety, are susceptible to oxidative degradation due to attack on the 3° benzylic hydrogen. This process is accentuated by elevated temperatures, such as occurs in turbine and other operating machinery.

Numerous oxidation and corrosion inhibitors have been found for use in lubricating compositions, and many combinations thereof have also been tested. In many instances, the effect of such combination is merely the additive effect of each of the inhibitors employed. In other cases, synergism is exhibited between the additives used, thus promoting to an unaccountable degree the oxidation and corrosion protection of the composition. It is impossible to predict, however, just which classes of inhibitors will be effective synergists until such combinations have actually been tested and found to be advantageous. Moreover, the results obtained in a particular chemical class of lubricating base is not indicative of the results to be expected in other organic media. For example, a class of oxidation or corrosion inhibitor which is effective in mineral oil may be substantially ineffective, or even act as a pro-oxidant, when utilized in an ester type oleaginous fluid. Likewise, synergizing parts or sets of additives which are effective for the purpose in mineral oil may have little or no advantage where employed in ester lubricants.

It is an object of the invention to provide a formulated lubricant composition containing a unique combination of additives which impact properties that meet various performance specifications. More specifically, an object of the present invention is to stabilize liquid mixed isopropylphenyl/phenyl phosphate lubricants with small amounts of additives to meet the oxidation, corrosion and rust inhibitory limits required by recognized standards.

The compositions of the present invention pass the ASTM-D 892 antifoam test. The volume of foam at the end of a 5-minute blowing period is less than 25 ml.

The compositions of the present invention pass the ASTM Rusting Test D 665-IP 135, 24 hours with distilled water (Part A) and 24 hours with synthetic sea water (Part B).

When tested as specified in ASTM Test D 445, the viscosity of the composition of the present invention does not change more than plus 15% or minus 5% from the original 160° F. viscosity, and the total acid number does not increase more than 2.0 mg KOH/g.

The corrosive properties of the compositions of the present invention are such that when tested by Federal Test Method Standard No. 791B, Method 5308.6, the change in weight of the steel, silver, aluminum alloy and magnesium alloy squares is no greater than plus or minus 0.2 milligram per square centimeter of surface and the change in weight of the copper square is no greater than plus or minus 0.4 milligram per square centimeter of surface.

Now, in accordance with the present invention, it has been found that despite the known susceptability to oxidation and viscosity changes of a liquid mixed isopropylphenyl/phenyl phosphate, such phosphate esters can be stabilized to an outstanding degree by the incorporation therein of from about 0.1 to about 2 weight percent of an amine selected from the group consisting of phenyl-$\alpha$-naphthylamine, phenyl-$\beta$-naphthylamine, and diphenylamine from about 0.01 to 0.1 weight percent benzotriazole, and from about 0.01 to about 0.25 weight percent of a corrosion inhibitor selected from the group consisting of oleylsarcosine, mixed mono- and dialkyl phosphates of the formula $RH_2PO_4$ and $R_2HPO_4$ with the optional addition of epoxidized soybean oil and mixed mono- and dialkyl phosphates of the formula $RH_2PO_4$ and $R_2HPO_4$ wherein R is an alkyl group of 8–12 carbon atoms. Throughout this specification, the additive concentration is expressed as percent by weight and is based on the isopropylphenyl/phenyl phosphate base stock.

The liquid mixed isopropylphenyl/phenyl phosphate base oil employed in the present invention may be conveniently prepared as described in U.S. Pat. No. 3,576,923 by the alkylation of phenol with from about 10% to 40% by weight of propylene based on the weight of the phenol and phosphorylation of the alkylate. The weight ratio of the alkyl moiety to the phenol moiety in such a phosphorylated alkylphenol/phenyl ester mixture may range from 0.005 to 0.65. Preferred phosphate esters are those obtained by phosphorylation of an alkylate having the following analysis:

| | |
|---|---|
| phenol | 29–57.2 weight percent |
| 2-isopropylphenol | 27–39 weight percent |
| 3-isopropylphenol<br>4-isopropylphenol | 9–14 weight percent |
| 2,6-diisopropylphenol | 2–5 weight percent |
| 2,4-diisopropylphenol | 3.5–8 weight percent |
| 2,5-diisopropylphenol<br>3,5-diisopropylphenol | 0.3–2 weight percent |
| 2,4,6-triisopropylphenol | 0.4–2 weight percent |
| 2,3,5-triisopropylphenol | <1 weight percent |

Particularly preferred is a phosphate ester base stock obtained by phosphorylation of an alkylate having the following analysis:

| | |
|---|---|
| phenol | 44–50 weight percent |
| 2-isopropylphenol | 30–35 weight percent |
| 3-isopropylphenol<br>4-isopropylphenol | 11–14 weight percent |
| 2,6-diisopropylphenol | 2–3 weight percent |
| 2,4-diisopropylphenol | 3.5–5 weight percent |
| 2,5-diisopropylphenol<br>3,5-diisopropylphenol | <1 weight percent |
| 2,4,6-triisopropylphenol | <1 weight percent |
| 2,3,5-triisopropylphenol | <1 weight percent |

The unexpected and remarkable benefits that can be achieved by the use of the additive combination of the present invention with such isopropylphenyl/phenyl phosphate esters will be shown by the following examples.

EXAMPLE 1

A prototype gas turbine lubricant is prepared using as the base oil a liquid mixed isopropylphenyl/phenyl phosphate ester obtained by the phosphorylation of an alkylate having the following analysis:

| | |
|---|---|
| phenol | 44 weight percent |
| 2-isopropylphenol | 33 weight percent |
| 3-isopropylphenol<br>4-isopropylphenol | 12.5 weight percent |
| 2,6-diisopropylphenol | 3 weight percent |
| 2,4-diispropylphenol | 5 weight percent |
| 2,5-diisopropylphenol<br>3,5-diiscopropylphenol | <1 weight percent |
| 2,4,6-triisopropylphenol | <1 weight percent |
| 2,3,5-triisopropylphenol | <1 weight percent |

To this base oil is added 0.001% by weight of a dimethyl silicone polymer antifoam composition (Antifoam A, manufactured by the Dow Chemical Co., Midland, Michigan, and 1.0 percent by weight phenyl-β-naphthylamine.

The lubricant so obtained failed to pass the ASTM-D 892 antifoam test. The volume of foam at the end of the 5 minute blowing period is 28 ml.

EXAMPLE 2

A prototype gas turbine lubricant is prepared using as the base oil a liquid mixed isopropylphenyl/phenyl phosphate ester obtained by the phosphorylation of an alkylate having analysis given in Example 1 above.

To this base oil is added 0.001% by weight of a dimethyl silicone polymer antifoam composition (Antifoam A, manufactured by the Dow Chemical Co., Midland, Michigan), 0.5 percent by weight benzylhydroxytoluene and 0.1 percent by weight 2,6-di-tert-butyl-2-dimethylamino-p-cresol.

The lubricant so obtained failed to pass the corrosion-oxidation test. When tested in accordance with ASTM Test D445, the viscosity change at 100° F. is 23.6 percent, outside the specification, and the acid number is too high, 4.08 mg KOH/gm.

EXAMPLES 3–7

A gas turbine lubricant is prepared, using as the base oil a liquid mixed isopropylphenyl/phenyl phosphate ester obtained by the phosphorylation of an alkylate having the analysis given in Example 1.

To this base oil is added 0.001% by weight of a dimethyl silicone polymer antifoam composition (Antifoam A, manufactured by the Dow Chemical Co., Midland, Michigan). The other additives present in Examples 3–7 are shown in Table I. Examples 3–7 failed to pass the exacting standards discussed above in the specification, for reasons that are summarized in Table II.

EXAMPLE 8

A gas turbine lubricant is prepared using as the base oil a liquid mixed isopropylphenyl/phenyl phosphate ester obtained by the phosphorylation of an alkylate having the following analysis:

| | |
|---|---|
| phenol | 44 weight percent |
| 2-isopropylphenol | 33 weight percent |
| 3-isopropylphenol<br>4-isopropylphenol | 12.5 weight percent |
| 2,6-diisopropylphenol | 3 weight percent |
| 2,4-diispropylphenol | 5 weight percent |
| 2,5-diisopropylphenol<br>3,5-diiscopropylphenol | <1 weight percent |
| 2,4,6-triisopropylphenol | <1 weight percent |
| 2,3,5-triisopropylphenol | <1 weight percent |

To this base oil is added 0.001% by weight of a dimethyl silicone polymer antifoam composition (Antifoam A, manufactured by the Dow Chemical Co., Midland, Michigan), 1.0 percent phenyl-β-naphthylamine, 0.01 weight percent benzotriazole, 0.1 weight percent oleylsarcosine and 0.1 weight percent triethanolamine.

The lubricant so obtained passes the ASTM Rusting Test D 665-IP 135, 24 hours with distilled water (Part A) and 24 hours with synthetic salt water (Part B). When tested in accordance with ASTM Test D 445, the viscosity change at 100° F. is +11.27 percent, and the acid number is 1.45 mg KOH/gm.

The lubricant of this example is evaluated by means of the 72 hours 175° C. "five metal" corrosion-oxidation stability test. This test, which is finding increasing use in the evaluation of high temperature lubricants and hydraulic fluids, is described in Federal Test Method Standard No. 791B, Method 5308, and is carried out as follows. Weighed, polished one inch square specimens of copper, steel, aluminum, magnesium, and silver are tied together into a box, with the silver specimens as diagonals separating the copper and steel on one side and the aluminum, and magnesium on the other. The box is immersed in 100 milliliters of the test oil in an oxidation tube fitted with a reflux condenser, and air is bubbled through at a rate of 5 liters an hour while the oil is maintained at 175° C. for the 72 hours. When the test period is completed, the oil and metals are examined for evidence of oxidative degradation—for example, a large increase or decrease in oil viscosity, a large increase in the acid number, a large deposition of sludge, and corrosive attack on one or more of the metal specimens.

The change in the weight of the copper, steel, silver, magnesium alloy and aluminum alloy is given in Table II.

EXAMPLES 9-14

Gas turbine lubricants are prepared using as the base oil a liquid mixed isopropylphenyl/phenyl phosphate ester obtained as described in Example 1 above, using the base oil of that Example. The additive present in the composition of each Example is set forth in Table I and the physical properties are summarized in Table II.

EXAMPLES 15-60

Table I summarizes the additives present in the turbine lubricant of Examples 15-60. In each example the base oil is the liquid mixed isopropylphenyl/phenyl phosphate ester described above in Example 1.

The physical properties of the lubricant compositions disclosed in Example 15-60 are summarized in Table II. The lubricant compositions of Examples 28, 30, 54, 55 and 60 pass all tests.

The above examples are given in order to illustrate the remarkable improvement in properties of isopropylphenyl/phenyl phosphate esters achieved by employing the combination of additives described above and are not intended to be limiting, within the boundaries of the following claims.

TABLE I

| | EXAMPLES[1] | | | | | | | | | |
|---|---|---|---|---|---|---|---|---|---|---|
| WEIGHT PERCENT OF: | 1 | 2 | 3 | 4 | 5 | 6 | 7 | 8 | 9 | 10 |
| Phenyl-β-Naphthylamine | 1.0 | | | | | 1.0 | 1.0 | 1.0 | 1.0 | 1.0 |
| Benzylhydroxytoluene | | 0.5 | | | | | | | | |
| 2,6-di-tert-butyl-2-dimethylamino-p-cresol | | 0.1 | | 1.0 | 1.0 | | | | | |
| Aromatic Amine | | | | | | | | | | |
| Benzotriazole | | | | | | | 0.1 | 0.01 | 0.01 | 0.01 |
| Phenothiazine | | | 1.0 | | | | | | | |
| Dioctyldiphenylamine | | | | | 1.0 | | | | | |
| Oleylsarcosine | | | | | | 0.1 | 0.1 | 0.1 | 0.05 | |
| Triethanolamine | | | | | | 0.1 | 0.1 | 0.1 | 0.05 | |
| Barium Sulfonate Basic Salt | | | | | | | | | | |
| Epoxidized Soybean Oil | | | | | | | | | | |
| p-Alkylphenylnaphthylamine | | | | | | | | | | |
| Diphenylamine | | | | | | | | | | |
| Dodecylsuccinic Anhydride | | | | | | | | | | |
| Phenyl-α-naphthylamine | | | | | | | | | | 0.1 |
| Bis[4-dimethylamino-phenyl] methane | | | | | | | | | | |
| Mixed alkyl acid orthophosphate[2] | | | | | | | | | | |
| Tri(2-isopropylphenyl)phosphate | | | | | | | | | | |
| Vinylpyrrolidone | | | | | | | | | | |

| | EXAMPLES[1] | | | | | | | | | |
|---|---|---|---|---|---|---|---|---|---|---|
| WEIGHT PERCENT OF: | 11 | 12 | 13 | 14 | 15 | 16 | 17 | 18 | 19 | 20 |
| Phenyl-β-Naphthylamine | 1.0 | 1.0 | 1.0 | 1.0 | | 1.0 | 1.0 | | 1.0 | |
| Benzylhydroxytolune | | | | | | | | | | |
| 2,6-d-tert-butyl-2-dimethylamino-p-cresol | | | | | | | | | | |
| Aromatic Amine | | | | | | | | | | |
| Benzotriazole | 0.01 | 0.01 | 0.1 | 0.01 | | 0.1 | 0.01 | 0.01 | 0.01 | 0.01 |
| Phenothiazine | | | | | | | | | | |
| Dioctyldiphenylamine | | | | | | | | | | |
| Oleylsarcosine | 0.45 | 0.45 | | | | | | 0.1 | 0.1 | 0.1 |
| Triethanol Amine | | 0.45 | | | | | | 0.1 | 0.1 | 0.1 |
| Barium Sulfonate Basic Salt | | | | | | 0.25 | 0.25 | | | |
| Epoxidized Soybean Oil | | | 0.25 | 0.25 | | | | | | |
| p-Alkylphenylnaphthylamine | | | | | | | | | | 0.1 |
| p-Alkylphenylnaphthylamine | | | | | | | | 1.0 | | |
| Diphenylamine | | | | | | | | | | |
| Dodecylsuccinic Anhydride | | | | | | | | | | |
| Phenyl-α-naphthylamine | | | | | | | | | | |
| Bis[4-(dimethylamino)phenyl] | | | | | | | | | | |

TABLE I-continued

| | |
|---|---|
| methane | |
| Mixed alkyl acid orthophosphate[2] | |
| Tri(2-isopropylphenyl)phosphate | 5.0 |
| Vinylpyrrolidone | |

| | EXAMPLES[1] | | | | | | | | | |
|---|---|---|---|---|---|---|---|---|---|---|
| WEIGHT PERCENT OF: | 21 | 22 | 23 | 24 | 25 | 26 | 27 | 28 | 29 | 30 |
| Phenyl-β-Naphthylamine | 1.0 | 1.0 | 1.0 | 1.0 | | | 1.0 | | 1.0 | |
| Benzylhydroxy toluene | | | | | | | | | | |
| 2,6-di-tert-butyl-2-dimethylamino-p-cresol | | | | | | | | | | |
| Aromatic Amine | | | | | | | | | | |
| Benzotriazole | 0.01 | 0.01 | 0.01 | 0.01 | 0.01 | 0.01 | 0.01 | 0.01 | 0.01 | 0.01 |
| Phenothiazine | | | | | | | | | | |
| Dioctyldiphenylamine | | | | | | | | | | |
| Oleylsarcosine | | | | 0.1 | 0.2 | 0.1 | 0.1 | 0.1 | 0.1 | 0.1 |
| Triethanolamine | | 0.1 | | | 0.2 | 0.1 | | | 0.1 | |
| Barium Sulfonate Basic Salt | | | | | | | | | | |
| Epoxidized Soybean oil | | | | | | 0.25 | | | | |
| p-Alkylphenylnaphthylamine | | | | | | | | | | |
| Diphenylamine | | | | | 1.0 | | | | | 1.0 |
| Dodecylsuccinic Anhydride | 0.1 | 0.1 | 0.1 | | | | | | | |
| Phenyl-α-naphthylamine | | | | | | | | 1.0 | | |
| Bis[4-(dimethylamino)phenyl] methane | | | | | | | | | | |
| Mixed alkyl acid orthophosphate[2] | | | | | | | | | | |
| Tri(2-isopropylphenyl)phosphate | | | | | | | | | 0.1 | |
| Vinylpyrrolidone | | | | | | | | | | |

| | EXAMPLES[1] | | | | | | | | | |
|---|---|---|---|---|---|---|---|---|---|---|
| WEIGHT PERCENT OF: | 31 | 32 | 33 | 34 | 35 | 36 | 37 | 38 | 39 | 40 |
| Phenyl-β-Naphthylamine | 1.0 | 1.0 | 1.0 | 1.0 | | 1.0 | | | | |
| Benzylhydroxy toluene | | | | | | | | | | |
| 2,6-di-tert-butyl-2-dimethylamino-p-cresol | | | | | | | | | | |
| Aromatic Amine | | | | | | | | | | |
| Benzotriazole | 0.01 | 0.01 | 0.01 | 0.01 | 0.01 | 0.01 | 0.01 | 0.01 | 0.01 | 0.01 |
| Phenothiazine | | | | | | | | | | |
| Dioctyldiphenylamine | | | | | | | | | | |
| Oleylsarcosine | 0.1 | | 0.1 | 0.15 | | | | | | |
| Triethanolamine | | 0.1 | | | | | | | | |
| Barium Sulfonate Basic Salt | | | | | | | | | | |
| Epoxidized Soybean Oil | | | | | | | | | | |
| p-Alkylphenylnaphthylamine | | | | | | | | | | |
| Diphenylamine | | | | | 1.0 | | 1.0 | 1.0 | 10 | 1.0 |
| Dodecylsuccinic Anhydride | | | | | | | | | | |
| Phenyl-α-naphthylamine | | | | | | | | | | |
| Bis[4-(dimethylamino)phenyl] methane | | | | | | | | | | |
| Mixed Alkyl Acid Orthophosphate[2] | | | | | 0.1 | 0.1 | 0.05 | 0.025 | 0.01 | 0.005 |
| Tri(2-isopropylphenyl)phosphate | | | | | | | | | | |
| Vinylpyrrolidone | | | | | | | | | | |

| | EXAMPLES[1] | | | | | | | | | |
|---|---|---|---|---|---|---|---|---|---|---|
| WEIGHT PERCENT OF: | 41 | 42 | 43 | 44 | 45 | 46 | 47 | 48 | 49 | 50 |
| Phenyl-β-Naphthylamine | | | | | | | | | | |
| Benzylhydroxytoluene | | | | | | | | | | |
| 2,6-di-tert-butyl-2-dimethylamino-p-cresol | | | | | | | | | | |
| Aromatic Amine | | | | | | | | | | |
| Benzotriazole | 0.01 | 0.01 | 0.01 | 0.01 | 0.01 | 0.01 | 0.01 | 0.01 | 0.01 | 0.01 |
| Phenothiazine | | | | | | | | | | |
| Dioctyldiphenylamine | | | | | | | | | | |
| Oleylsarcosine | | | | | 0.2 | 0.5 | 0.1 | | 0.1 | |
| Triethanolamine | | | | | | | | | | |
| Barium Sulfonate Basic Salt | | | | | | | | | | |
| Epoxidized Soybean Oil | | | | | | | | 0.5 | 0.5 | |
| p-Alkylphenylnaphthylamine | | | | | | | | | | |
| Diphenylamine | | 1.0 | 1.0 | | | | | | | |
| Dodecylsuccinic Anhydride | | | | | | | | | | |
| Phenyl-α-naphthylamine | | | | 1.0 | 10 | 1.0 | 1.0 | 10 | 1.0 | 10 |
| Bis[4-(dimethylamino)phenyl] methane | | | | | | | | | | |
| Mixed alkyl acid orthophosphate[2] | 0.001 | | 0.1 | 0.5 | | | | | 0.025 | 0.005 |
| Tri(2-isopropylphenyl)phosphate | | | | | | | | | | |
| Vinylpyrrolidone | | | | | | | | | | |

| | EXAMPLES[1] | | | | | | | | | |
|---|---|---|---|---|---|---|---|---|---|---|
| WEIGHT PERCENT OF: | 51 | 52 | 53 | 54 | 55 | 56 | 57 | 58 | 59 | 60 |
| Phenyl-β-naphthylamine | | | | | | | | | | |
| Benzylhydroxytoluene | | | | | | | | | | |

TABLE I-continued

| | | | | | | | | | | |
|---|---|---|---|---|---|---|---|---|---|---|
| 2,6-di-tert-butyl-2-dimethylamino-p-cresol | | | | | | | | 0.06 | 0.02 | |
| Aromatic Amine | | | | | | | | | | |
| Benzotriazole | 0.01 | 0.01 | 0.01 | 0.01 | 0.01 | | 0.01 | 0.01 | 0.01 | 0.01 |
| Phenothiazine | | | | | | | | | | |
| Dioctyldiphenylamine | | | | | | | | | | |
| Oleylsarcosine | | | 0.1 | | | | | | | |
| Triethanolamine | | | | | | | | | | |
| Barium Sulfonate Basic Salt | | | | | | | | | | |
| Epoxidized Soybean Oil | | | 0.5 | | | | | | | |
| p-Alkylphenylnaphthylamine | | | | | | | | | | |
| Diphenylamine | | | 1.0 | | 0.5 | 1.0 | 1.0 | 1.0 | 1.0 | 1.0 |
| Dodecylsuccinic Anhydride | | | | | | | | | | |
| Phenyl-α-naphthylamine | 1.0 | 1.0 | 1.0 | | | | | | | |
| Bis[4-(dimethylamino)phenyl] methane | | | | 1.0 | | | | | | |
| Mixed alkyl acid orthophosphate[2] | 0.1 | 0.025 | | 0.025 | 0.01 | 0.01 | | | 0.01 | 0.01 |

[1]All Examples contain 0.001% antifoam.
[2]Having the general formula $RH_2PO_4$ and $R_2HPO_4$ wherein R is an alkyl group of 8-12 carbon atoms.

TABLE II

| | Acid Number mgKOH/gm | | Kinetic Viscosity cts. at 100° F. | | Percent Viscosity | FTMS 5308.6 72 Hours at 175° C. Corrosion-Oxidation Test mgs/cm² | | | | | |
|---|---|---|---|---|---|---|---|---|---|---|---|
| Examples | Fresh | Oxid. | Fresh | Oxid. | Change | Copper | Steel | Magnesium | Aluminum | Silver | Failed |
| 1 | 0.51 | 1.34 | 33.31 | 36.54 | + 9.7 | −0.211 | −0.022 | −0.015 | −0.051 | −0.124 | 5 |
| 2 | 0.17 | 4.08 | 32.25 | 39.85 | +23.6 | −0.291 | −0.007 | −0.029 | −0.066 | −0.044 | 1,3 |
| 3 | 0.16 | 4.19 | 33.10 | 43.61 | +31.75 | −0.423 | 0.000 | 0.000 | +0.015 | −0.197 | 1,3 |
| 4 | 0.16 | 25.7 | 33.17 | 72.10 | | −0.788 | −0.015 | −0.007 | −0.036 | −0.117 | 1,3 |
| 5 | 0.16 | 16.42 | 33.27 | 61.29 | | −0.350 | −0.022 | −0.015 | −0.066 | −0.124 | 1,3 |
| 6 | 1.19 | 1.30 | 32.77 | 36.69 | +11.96 | −0.561 | +0.029 | −0.036 | +0.007 | −0.022 | 2 |
| 7 | 2.01 | 2.96 | 33.08 | 36.60 | +10.64 | +0.116 | +0.066 | +0.058 | =0.051 | +0.175 | X |
| 8 | 0.35 | 1.45 | 32.20 | 35.83 | ×11.27 | +0.168 | +0.051 | +0.080 | +0.066 | +0.116 | X |
| 9 | | | | | | | | | | | 4 |
| 10 | | | | | | | | | | | 4 |
| 11 | | | | | | | | | | | |
| 12 | | | | | | | | | | | 4 |
| 13 | 1.28 | 2.57 | 33.34 | 37.16 | +11.46 | −0.007 | 0.000 | −0.015 | 0.000 | −0.022 | 1 |
| 14 | 0.46 | 1.64 | 32.39 | 36.83 | +13.71 | +0.058 | +0.029 | +0.095 | +0.007 | +0.002 | X |
| 15 | | | 35.59 | 90.0 | | +0.248 | +0.058 | +0.087 | +0.073 | +0.197 | 3 |
| 16 | 0.65 | 1.59 | 33.10 | 37.42 | +13.05 | −0.080 | −0.015 | −0.044 | −0.058 | −0.102 | 5 |
| 17 | | | | | | | | | | | |
| 18 | 0.28 | 1.32 | 32.18 | 35.36 | +9.88 | +0.256 | +0.073 | +0.029 | +0.066 | +0.080 | 4 |
| 19 | 0.52 | 1.36 | 33.23 | 35.46 | +6.71 | +0.124 | −0.066 | −0.073 | −0.015 | +0.100 | 4 |
| 20 | 0.77 | 1.90 | 31.76 | 34.80 | +9.57 | −0.110 | −0.168 | −0.066 | −0.036 | −0.051 | 4 |
| 21 | | | | | | | | | | | 4 |
| 22 | | | | | | | | | | | 4 |
| 23 | | | | | | | | | | | 4 |
| 24 | | | | | | | | | | | 4 |
| 25 | | | | | | | | | | | 4 |
| 26 | | | | | | | | | | | 4 |
| 27 | 0.40 | 1.42 | 28.92 | 34.82 | +20.40 | −0.146 | −0.007 | −0.058 | −0.051 | −0.087 | 3 |
| 28 | 0.40 | 1.04 | 31.40 | 34.45 | + 9.71 | +0.131 | 0.000 | −0.022 | −0.007 | −0.138 | X |
| 29 | | | | | | | | | | | 4 |
| 30 | 0.38 | 1.13 | 30.71 | 33.10 | + 7.78 | +0.142 | +0.007 | −0.011 | −0.014 | −0.058 | X |
| 31 | | | | | | | | | | | 4 |
| 32 | | | | | | | | | | | 4 |
| 33 | | | | | | | | | | | 4 |
| 34 | | | | | | | | | | | 4 |
| 35 | 0.55 | 2.76 | 31.10 | 34.16 | + 9.84 | −0.109 | −0.051 | +0.066 | +0.051 | −0.007 | 1 |
| 36 | | | | | | | | | | | |
| 37 | 0.38 | 2.03 | 31.21 | 34.35 | +10.06 | −0.146 | +0.015 | +0.044 | +0.022 | −0.007 | 1 |
| 38 | 0.29 | 1.92 | 31.31 | 34.46 | +10.06 | −0.124 | 0.000 | +0.066 | +0.036 | −0.29 | 6 |
| 39 | | | | | | | | | | | |
| 40 | 0.34 | 4.61 | 31.25 | 39.72 | +27.10 | −0.069 | +0.215 | +0.219 | +0.179 | +0.051 | 6 |
| 41 | | | | | | | | | | | 4 |
| 42 | | | | | | | | | | | 4 |
| 43 | 0.57 | 3.85 | 31.79 | 34.98 | +10.03 | −0.124 | +0.015 | +0.007 | +0.022 | 0.000 | 1,6 |
| 44 | | | | | | | | | | | |
| 45 | | | | | | | | | | | 4 |
| 46 | | | | | | | | | | | 4 |
| 47 | 0.40 | 4.17 | 31.40 | 37.6 | +19.75 | −0.182 | 0.000 | +0.007 | 0.000 | −0.066 | 6 |
| 48 | 0.32 | 4.90 | 31.95 | 38.91 | +21.78 | +0.175 | +0.022 | +0.015 | +0.022 | −0.029 | 6 |
| 49 | 0.32 | 4.30 | 32.13 | 39.40 | +22.63 | +0.012 | 0.000 | +0.007 | +0.007 | −0.051 | 6 |
| 50 | 0.36 | 4.32 | 31.71 | 38.45 | +21.26 | −0.080 | +0.087 | +0.080 | +0.080 | 0.059 | 4,6 |
| 51 | | | | | | | | | | | |
| 52 | 0.20 | 70.0 | 31.71 | 128.0 | | −0.929 | +0.077 | +0.077 | +0.066 | −0.066 | 6 |
| 53 | 0.39 | 7.01 | 31.53 | 42.56 | +34.98 | +0.408 | +0.117 | +0.109 | +0.124 | +0.080 | 6 |
| 54 | 0.28 | 1.08 | 30.93 | 43.51 | +11.57 | +0.117 | +0.044 | +0.051 | +0.051 | +0.022 | X |
| 55 | 0.10 | 0.51 | 28.49 | 29.84 | + 4.74 | −0.102 | +0.007 | 0.000 | 0.000 | 0.000 | X |

TABLE II-continued

| Examples | Acid Number mgKOH/gm Fresh | Acid Number mgKOH/gm Oxid. | Kinetic Viscosity cts. at 100° F. Fresh | Kinetic Viscosity cts. at 100° F. Oxid. | Percent Viscosity Change | FTMS 5308.6 72 Hours at 175° C. Corrosion-Oxidation Test mgs/cm² Copper | Steel | Magnesium | Aluminum | Silver | Failed |
|---|---|---|---|---|---|---|---|---|---|---|---|
| 56 | | | | | | | | | | | |
| 57 | | | | | | | | | | | |
| 58 | | | | | | | | | | | |
| 59 | | | | | | | | | | | |
| 60 | 0.04 | 0.81 | 29.78 | 32.92 | + 9.5 | −0.062 | +0.040 | +0.132 | +0.094 | −0.022 | X |

X Passed.
1. Failed Acid No. Test.
2. Failed Copper Loss.
3. Failed Viscosity Change.
4. Failed Rust Test.
5. Failed Foam Test.
6. Corrosion and Oxidation test - 168 hours at 175° C.

What is claimed is:

1. A fire resistant lubricant composition comprising a liquid mixed isopropylphenyl/phenyl phosphate ester base oil and in admixture therewith from about 0.1 to 2.0 weight percent of an amine selected from the group consisting of phenyl-α-naphthylamine, phenyl-β-naphthylamine and diphenylamine; from about 0.01 to 0.1 weight percent benzotriazole and from about 0.005 to 0.25 weight percent of a corrosion inhibitor selected from the group consisting of oleylsarcosine, and a mixed mono- and dialkyl phosphate of the formula $RH_2PO_4$ and $R_2HPO_4$, wherein R is an alkyl group of 8–12 carbon atoms.

2. The lubricant composition of claim 1 wherein the amine is phenyl-α-naphthylamine.

3. The lubricant composition of claim 2 wherein the said isopropylphenyl/phenyl phosphate ester composition is obtained by phosphorylation of an alkylate having the following analysis:

| | |
|---|---|
| phenol | 44–50 weight percent |
| 2-isopropylphenol | 30–35 weight percent |
| 3-isopropylphenol<br>4-isopropylphenol | 11–14 weight percent |
| 2,6-diisopropylphenol | 2–3 weight percent |
| 2,4-diisopropylphenol | 3.5–5 weight percent |
| 2,5-diisopropylphenol<br>3,5-diisopropylphenol | <1 weight percent |
| 2,4,6-triisopropylphenol | <1 weight percent |
| 2,3,5-triisopropylphenol | <1 weight percent |

4. The lubricant composition of claim 2 wherein the phenyl-α-naphthylamine is 1 percent by weight.

5. The lubricant composition of claim 4 wherein the amount of benzotriazole is 0.1 percent by weight.

6. The lubricant composition of claim 5 wherein the corrosion inhibitor is oleylsarcosine.

7. The lubricant composition of claim 6 wherein the amount of oleylsacosine is about 0.1 percent by weight.

8. The lubricant composition of claim 1 wherein the amine is phenyl-β-naphthylamine.

9. The lubricant composition of claim 8 wherein the said isopropylphenyl/phenyl phosphate ester is obtained by phosphorylation of an alkylate having the following analysis:

| | |
|---|---|
| phenol | 44–50 weight percent |
| 2-isopropylphenol | 30–35 weight percent |
| 3-isopropylphenol<br>4-isopropylphenol | 11–14 weight percent |

-continued

| | |
|---|---|
| 2,6-diisopropylphenol | 2–3 weight percent |
| 2,4-diisopropylphenol | 3.5–5 weight percent |
| 2,5-diisopropylphenol<br>3,5-diisopropylphenol | <1 weight percent |
| 2,4,6-triisopropylphenol | <1 weight percent |
| 2,3,5-triisopropylphenol | <1 weight percent |

10. The lubricant composition of claim 8 wherein the amount of phenyl-β-naphthylamine is 1 percent by weight.

11. The lubricant composition of claim 10 wherein the amount of benzotriazole is 0.01 percent by weight.

12. The lubricant composition of claim 11 wherein the corrosion inhibitor is oleylsarcosine.

13. The lubricant composition of claim 12 wherein the amount of oleylsarcosine is about 0.1 percent by weight.

14. The lubricant composition of claim 1 wherein the amine is diphenylamine.

15. The lubricant composition of claim 14 wherein the said isopropylphenyl/phenyl phosphate ester composition is obtained by phosphorylation of an alkylate having the following analysis:

| | |
|---|---|
| phenol | 44–50 weight percent |
| 2-isopropylphenol | 30–35 weight percent |
| 3-isopropylphenol<br>4-isopropylphenol | 11–14 weight percent |
| 2,6-diisopropylphenol | 2–3 weight percent |
| 2,4-diisopropylphenol | 3.5–5 weight percent |
| 2,5-diisopropylphenol<br>3,5-diisopropylphenol | <1 weight percent |
| 2,4,6-triisopropylphenol | <1 weight percent |
| 2,3,5-triisopropylphenol | <1 weight percent |

16. The lubricant composition of claim 14 wherein the amount of diphenylamine is 1 percent by weight.

17. The lubricant composition of claim 16 wherein the amount of benzotriazole is 0.01 percent by weight.

18. The lubricant composition of claim 17 wherein the corrosion inhibitor is oleylsarcosine.

19. The lubricant composition of claim 18 wherein the amount of oleylsarcosine is about 0.1 percent of weight.

20. The lubricant composition of claim 17 wherein the corrosion inhibitor is a mixed mono- and dialkyl phosphate of the formula $RH_2PO_4$ and $R_2HPO_4$ wherein R is an alkyl group of 8–12 carbon atoms.

21. The lubricant composition of claim 20 wherein the amount of mono- and dialkyl phosphates is 0.01 percent by weight.

* * * * *

UNITED STATES PATENT AND TRADEMARK OFFICE

CERTIFICATE OF CORRECTION

PATENT NO. : 4,169,800

DATED : October 2, 1979

INVENTOR(S) : Harry Dounchis

It is certified that error appears in the above-identified patent and that said Letters Patent are hereby corrected as shown below:

Column 2, line 33, "impact" should read --impart--. Column 4, line 7, "3,5-diiscopropylphenol" should read --3,5-diisopropylphenol--; line 14, "Michigan," should read --Michigan),--; line 65, "3,5-diiscopropylphenol" should read --3,5-diisopropylphenol--. Column 5, Table I, line 20, "Bis[4-dimethylamino-phenyl]" should read --Bis[4-(dimethylamino)phenyl]--; line 28, "Benzylhydroxytolune" should read --Benzylhydroxytoluene--; line 37, Examples 16 and 17, opposite Barium Sulfonate Basic Salt, should read --0.25--, two occurrences; line 40, second occurence, "p-Alkylphenylnaphthylamine 1.0" should be deleted; line 41, Example 18, opposite Diphenylamine, should read --1.0--. Column 6, line 21, "Example" should read --Examples--. Column 8, Table I-continued, line 27, Example 29, opposite Tri-(2-isopropylphenyl)phosphate, "0.1" should be deleted; line 28, Example 29, opposite Vinylpyrrolidone, should read --0.1--; line 69, Examples 45, 48 and 50, opposite Phenyl-α-naphthylamine, "10, 10, 10" should read --1.0, 1.0, 1.0--. Column 9, Example 8, line 12, under Percent Viscosity Change "X11.27" should read --+11.27--; Example 54, under Kinetic Viscosity, Oxid. "43.51" should read --34.51--.

UNITED STATES PATENT AND TRADEMARK OFFICE

CERTIFICATE OF CORRECTION

PATENT NO. : 4,169,800

DATED : October 2, 1979

INVENTOR(S) : Harry Dounchis

It is certified that error appears in the above-identified patent and that said Letters Patent are hereby corrected as shown below:

Column 10, Table II, line 12, Example 7, under Aluminum, "=0.051" should read --+0.051--. Column 11, Claim 7, line 2, "oleylsacosine" should read --oleylsarcosine--.

Signed and Sealed this

*Twelfth* Day of *February 1980*

[SEAL]

*Attest:*

SIDNEY A. DIAMOND

*Attesting Officer*

*Commissioner of Patents and Trademarks*